US008118513B2

(12) United States Patent
Haraldsson

(10) Patent No.: US 8,118,513 B2
(45) Date of Patent: Feb. 21, 2012

(54) BINDER LOCK MECHANISM INCLUDING A MANUALLY ADJUSTABLE LOCKING BAR

(75) Inventor: Tore Haraldsson, Smålandsstenar (SE)

(73) Assignee: Keba Sweden AB, Smålandsstenar (SE)

( * ) Notice: Subject to any disclaimer, the term of this patent is extended or adjusted under 35 U.S.C. 154(b) by 720 days.

(21) Appl. No.: 12/281,604

(22) PCT Filed: Mar. 1, 2007

(86) PCT No.: PCT/SE2007/050121

§ 371 (c)(1),
(2), (4) Date: Sep. 4, 2008

(87) PCT Pub. No.: WO2007/102778

PCT Pub. Date: Sep. 13, 2007

(65) Prior Publication Data

US 2009/0052978 A1 Feb. 26, 2009

(30) Foreign Application Priority Data

Mar. 8, 2006 (SE) ..... 0600514

(51) Int. Cl.
*B42F 3/04* (2006.01)
*B42F 13/06* (2006.01)
*B42F 13/20* (2006.01)

(52) U.S. Cl. ..... 402/33; 402/39; 402/44; 402/29; 402/30; 402/21

(58) Field of Classification Search ..... 402/29–31, 402/33–35, 39, 42, 44, 45, 61, 62
See application file for complete search history.

(56) References Cited

U.S. PATENT DOCUMENTS 2,135,943 A * 11/1938 Kornahrens ..... 402/76
2,247,397 A * 7/1941 Oman ..... 402/33

(Continued)

FOREIGN PATENT DOCUMENTS

WO 2004/065136 A2 8/2004

OTHER PUBLICATIONS

Swedish Patent Office, Intl Search Report in PCT/SE2007/050121, Jun. 18, 2007.

(Continued)

*Primary Examiner* — Dana Ross
*Assistant Examiner* — Kyle Grabowski
(74) *Attorney, Agent, or Firm* — Potamac Patent Group PLLC

(57) ABSTRACT

A binder lock mechanism includes a manually adjustable locking bar and co-operative locking-hook parts. Pair-wise mutually overlappable locking-hook parts are connected with and project from a respective binder end half, and are situated at mutual distances from each other. The binder end halves are connected by an intermediate pivot joint. The pair-wise mutually overlappable locking-hook parts present openings adapted to receive a respective lock lever connected with the locking bar and have a respective lock lever permanently received on a common binder end half in a mating opening in an assembled state. The lock levers are arranged at a tip portion and at a waved part, respectively, of the locking bar in such a way that they are situated on a common line through the bar, which is retained by a counter-directed resilient tongue situated on the locking bar and a stopper and co-operatable counter-stoppers situated on the binder end.

8 Claims, 7 Drawing Sheets

U.S. PATENT DOCUMENTS

Figure 1:
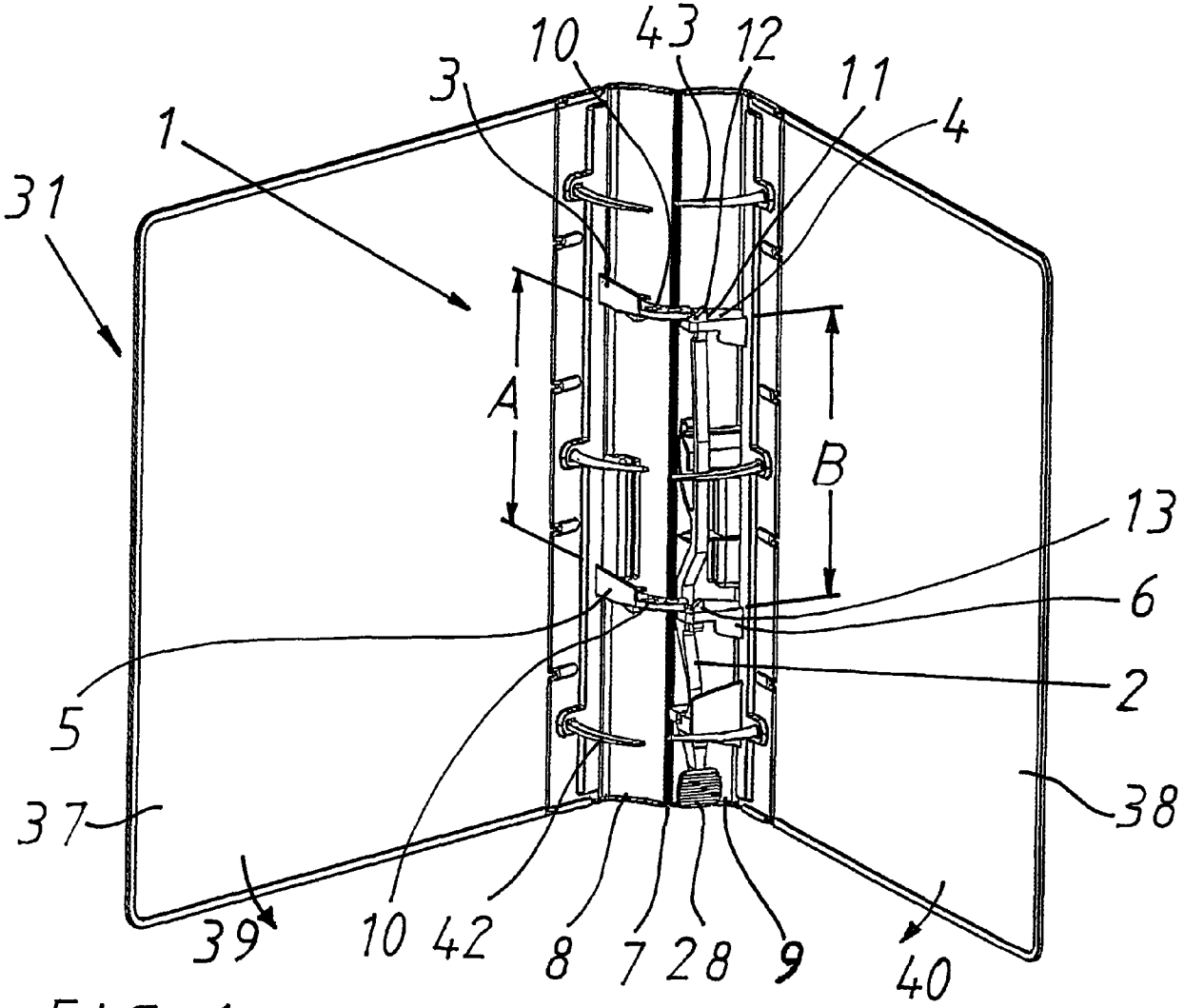

| | | | | | |
|---|---|---|---|---|---|
| 2,365,643 | A | * | 12/1944 | Martin | 402/32 |
| 2,421,799 | A | * | 6/1947 | Martin | 402/33 |
| 2,865,377 | A | * | 12/1958 | Schroer et al. | 402/33 |
| 2,891,553 | A | * | 6/1959 | Acton | 402/33 |
| 4,352,582 | A | * | 10/1982 | Eliasson | 402/38 |
| 6,036,394 | A | | 3/2000 | Cheng | |
| 6,293,722 | B1 | | 9/2001 | Holbrook et al. | |
| 2002/0122687 | A1 | | 9/2002 | Horn | |
| 2004/0151532 | A1 | * | 8/2004 | Haraldsson | 402/35 |

OTHER PUBLICATIONS

Swedish Patent Office, Intl Preliminary Report on Patentability in PCT/SE2007/050121, Sep. 18, 2008.

* cited by examiner

BINDER LOCK MECHANISM INCLUDING A MANUALLY ADJUSTABLE LOCKING BAR

The present invention relates to a binder lock mechanism that comprises a manually adjustable locking bar and locking-hook parts co-operating with said bar.

Known mechanisms to provide locking of the holding prongs of binders in a desired intended shut or half-open position are of varying design and also having different functions. They are more or less intricate to manufacture as well as assemble but also to use. The mechanisms that consist of metal become heavy and costly as well as frequently require a complicated assembly of all details included. The mechanisms manufactured from plastic comprise complicated forms of the parts, and the strength of the lock parts also varies substantially between different makes and designs. For instance, it is not always exact motion actuation that is obtained when the actuation button of the mechanisms is pressed down to open the binder, owing to the complicated mutual co-operation of the parts and because of the slender dimensions and design of the parts, respectively.

Examples of a known mechanism are shown in US2002/0122687A1. In that connection, a manually actuatable depressable gripping member is present in order to be able to actuate the locking parts of the mechanism. However, said mechanism is extraordinarily complicated both to manufacture and also to operate.

Therefore, the main object with the present invention is primarily to solve, among others, the above-mentioned problems in a reliable and efficient way.

Said object is achieved by means of a binder lock mechanism according to the present invention that substantially is characterized in that pair-wise mutually overlapable locking-hook parts, projecting from a respective binder end half, connected with the same, and situated at mutual distances from each other—said binder end halves being connected by an intermediate pivot joint—present openings adapted to receive a respective lock lever connected with the locking bar and have a respective lock lever permanently received on the common binder end half in the mating opening in the assembled state, that said lock levers are arranged at the tip portion and at a waved part, respectively, of the locking bar in such a way that they are situated on a common line through the bar, which is retained by means of a counter-directed resilient tongue, situated on said locking bar, as well as a stopper and co-operatable counter-stoppers situated on the binder end.

Figure 2:
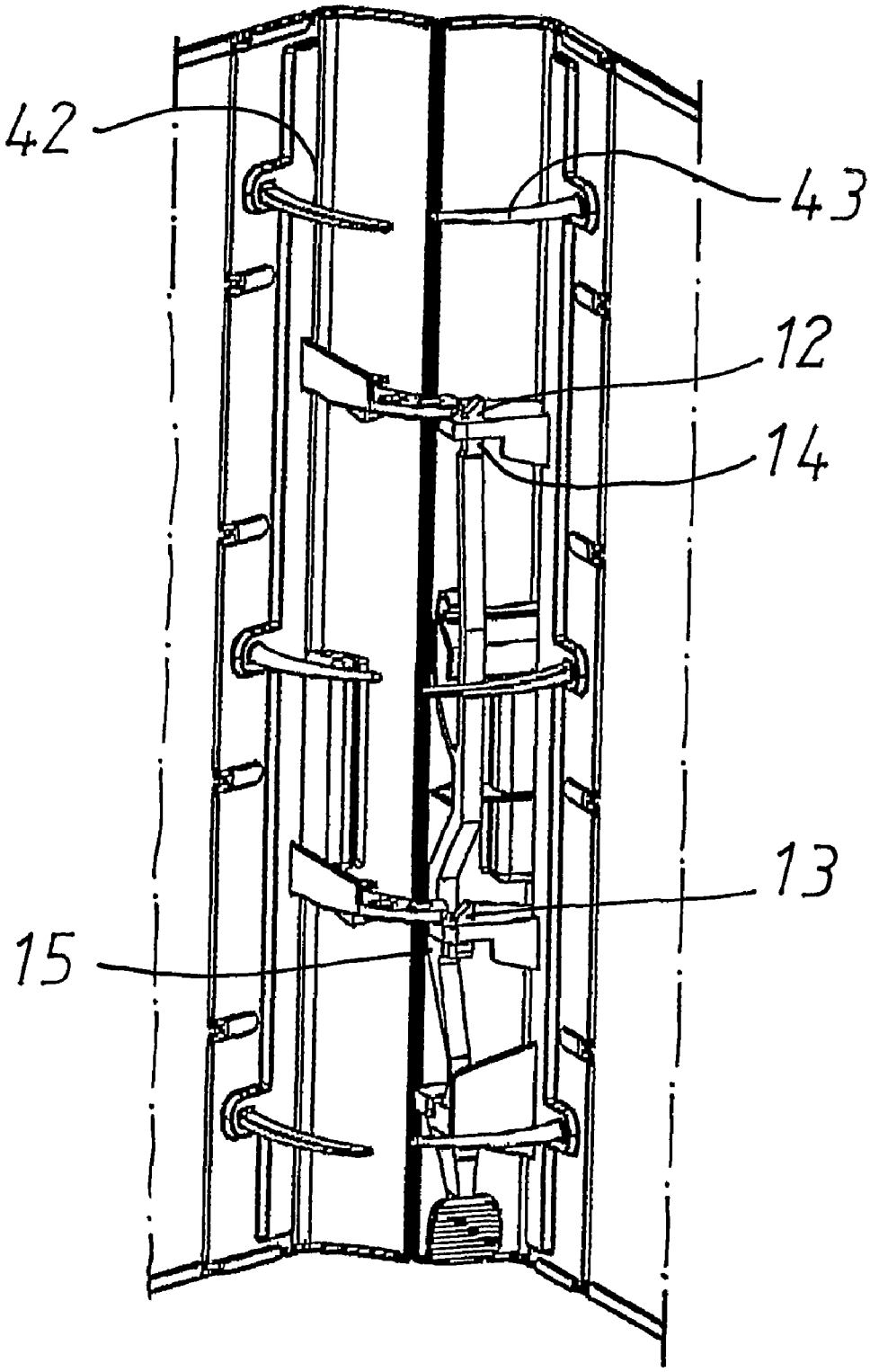
Figure 3:
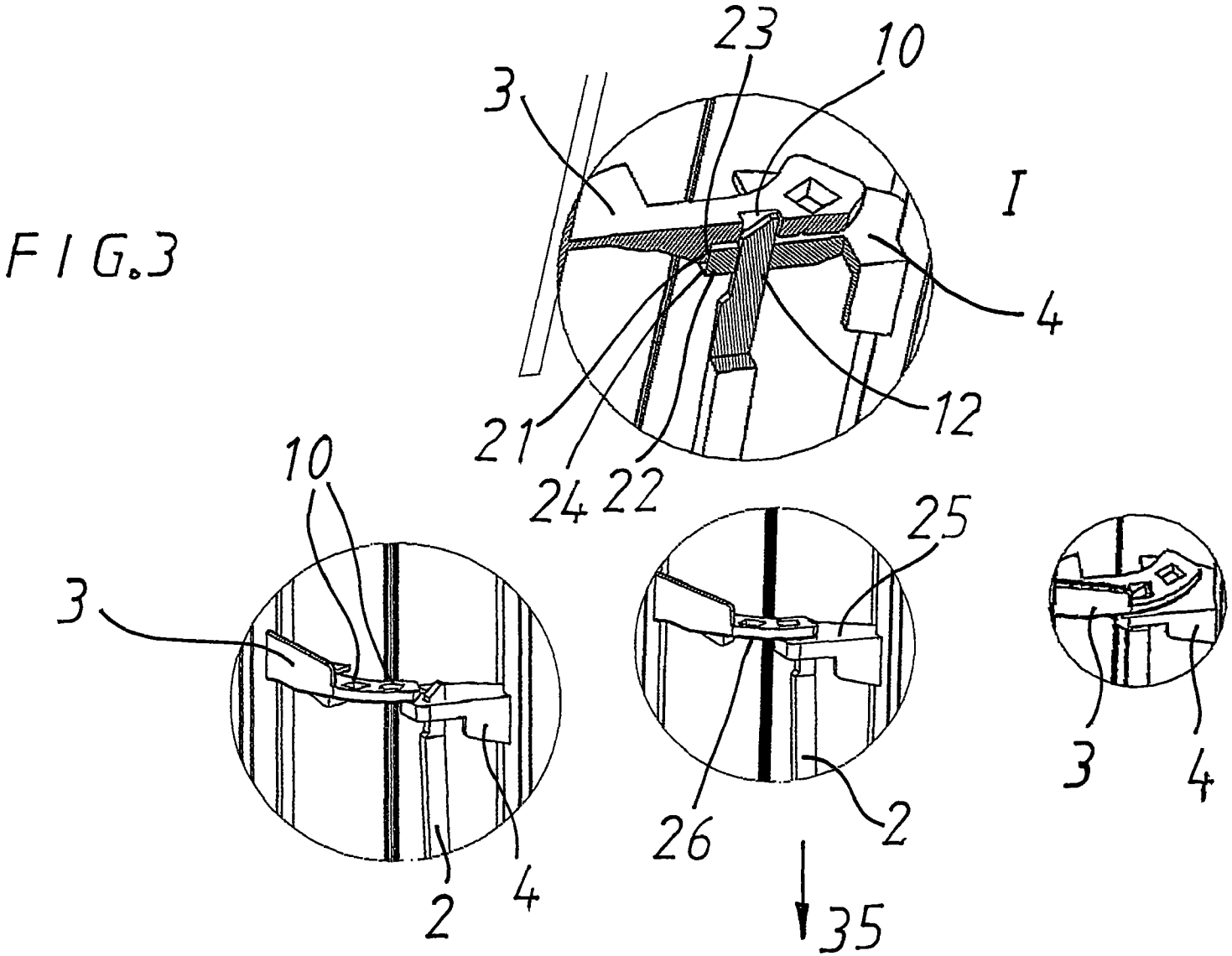
Figure 5:
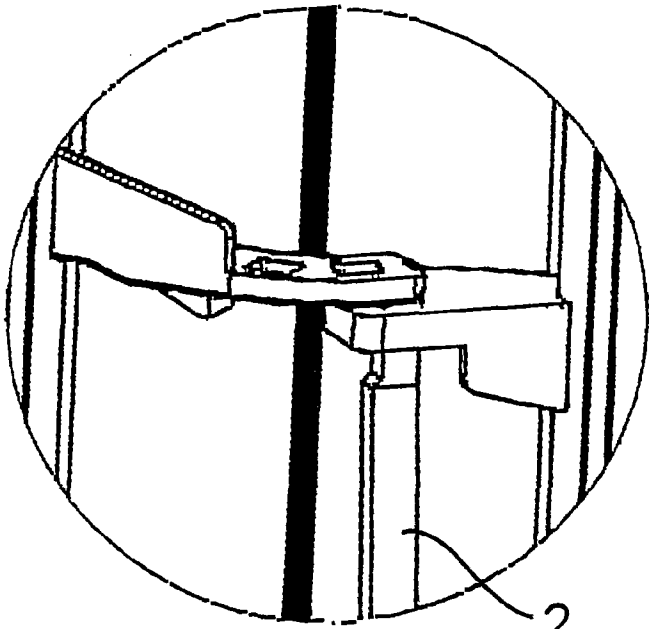
Figure 6:
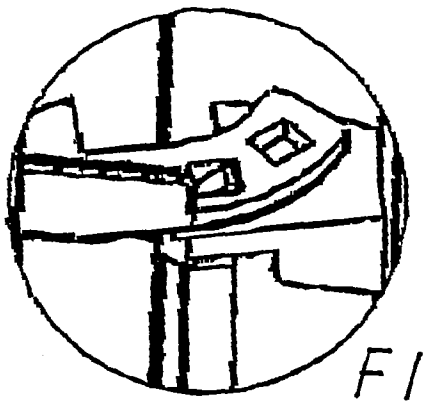
Figure 4:
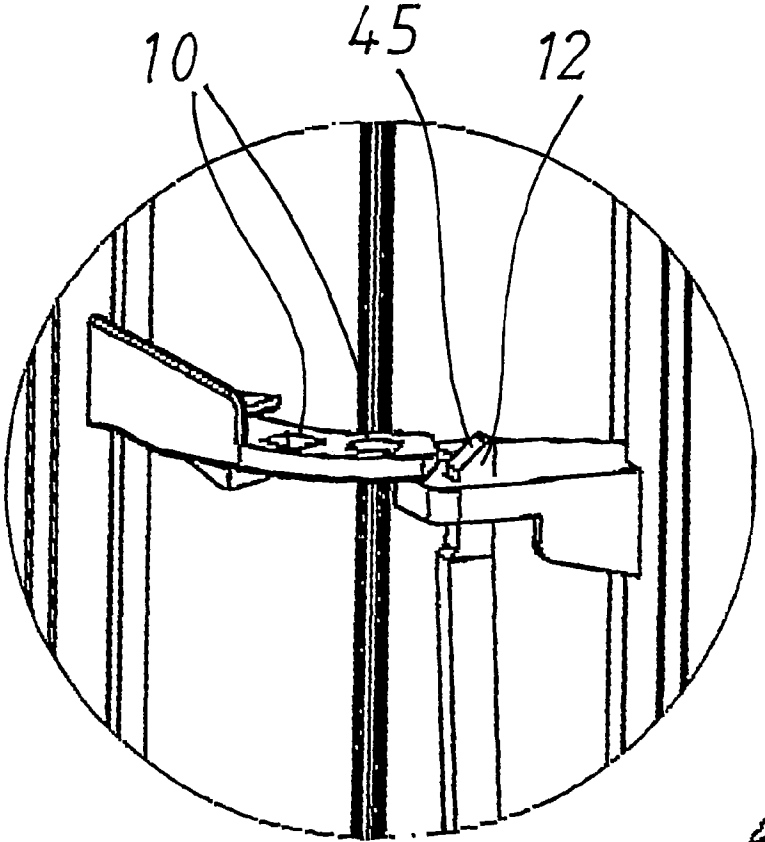
Figure 7:
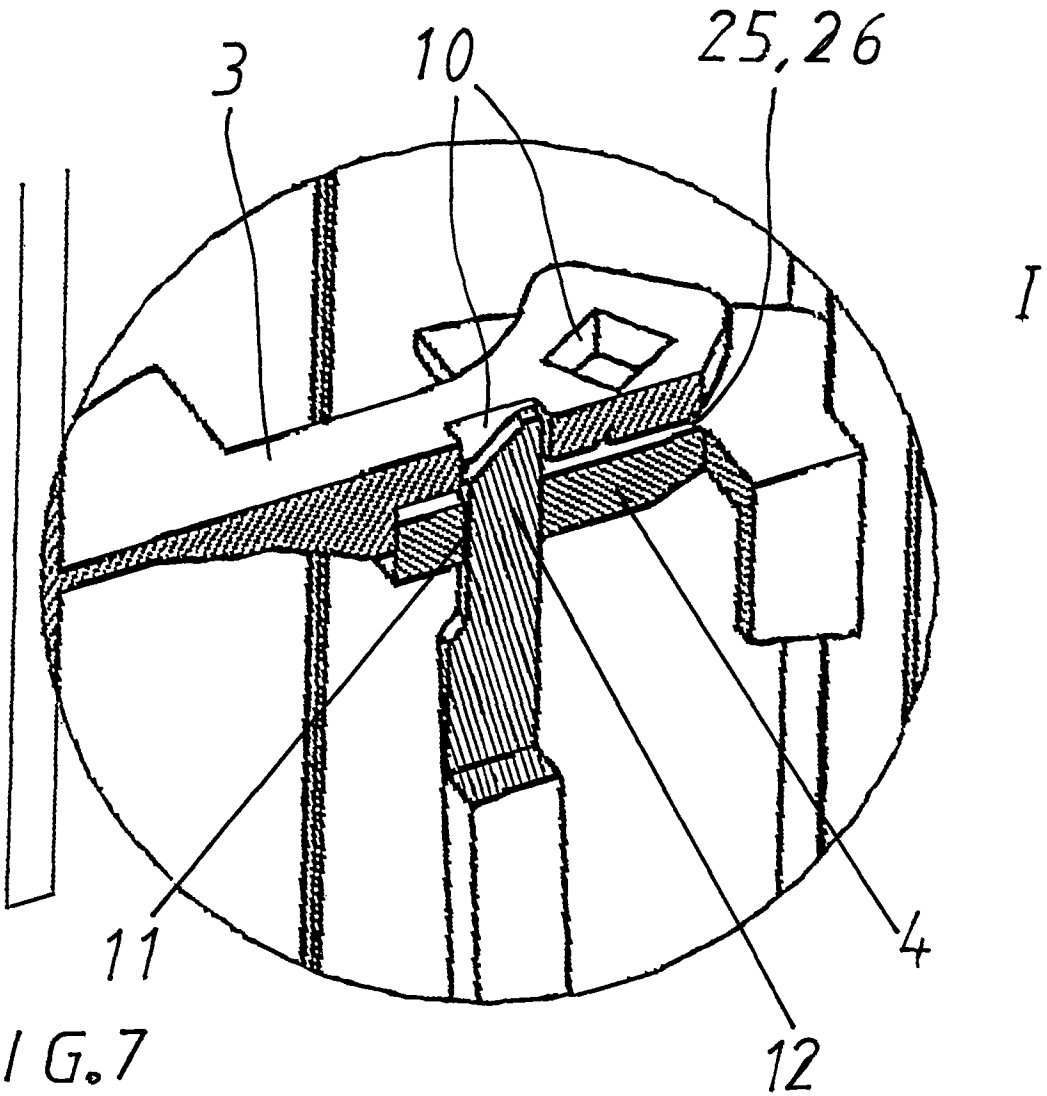
Figure 8:
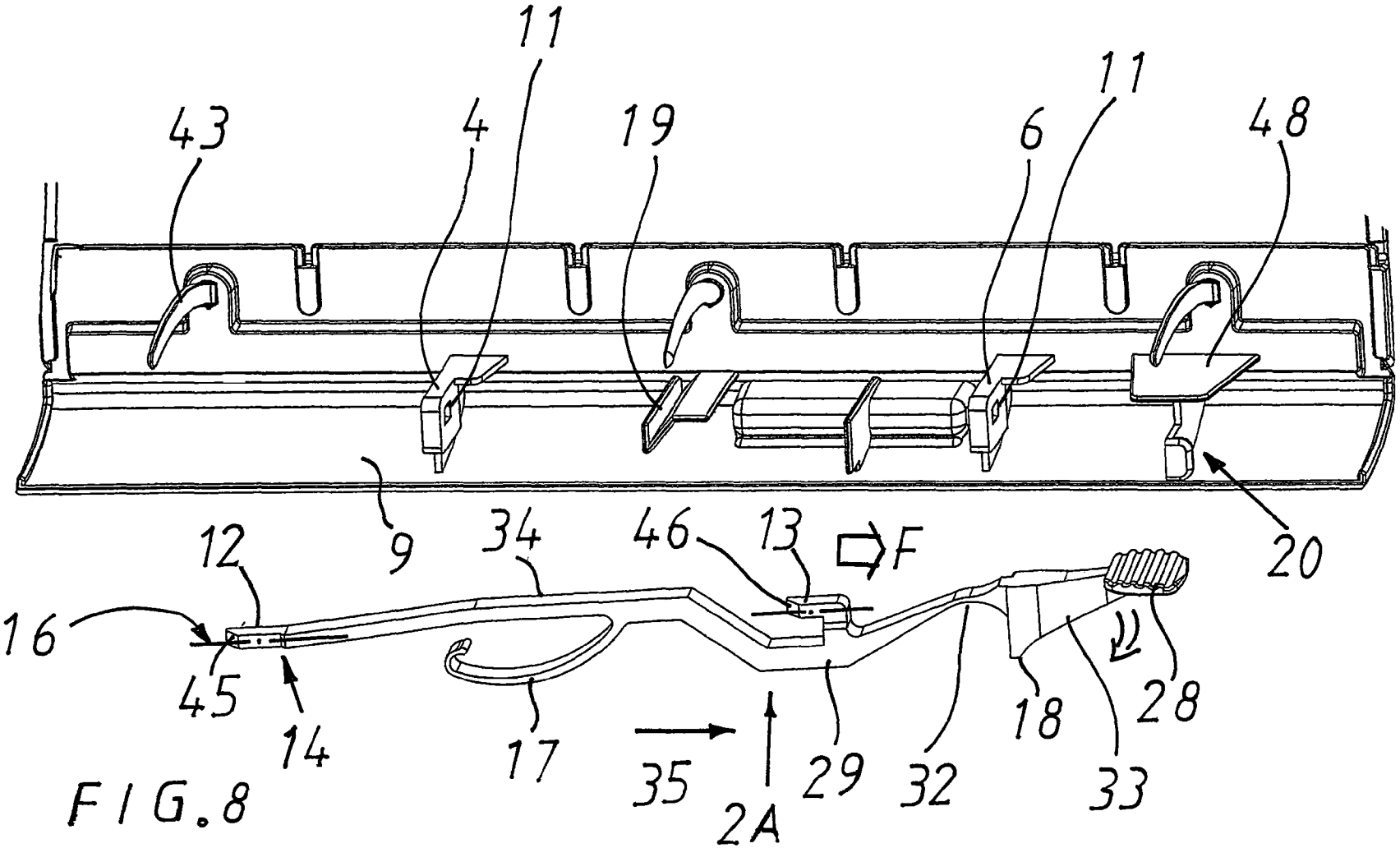
Figure 9:
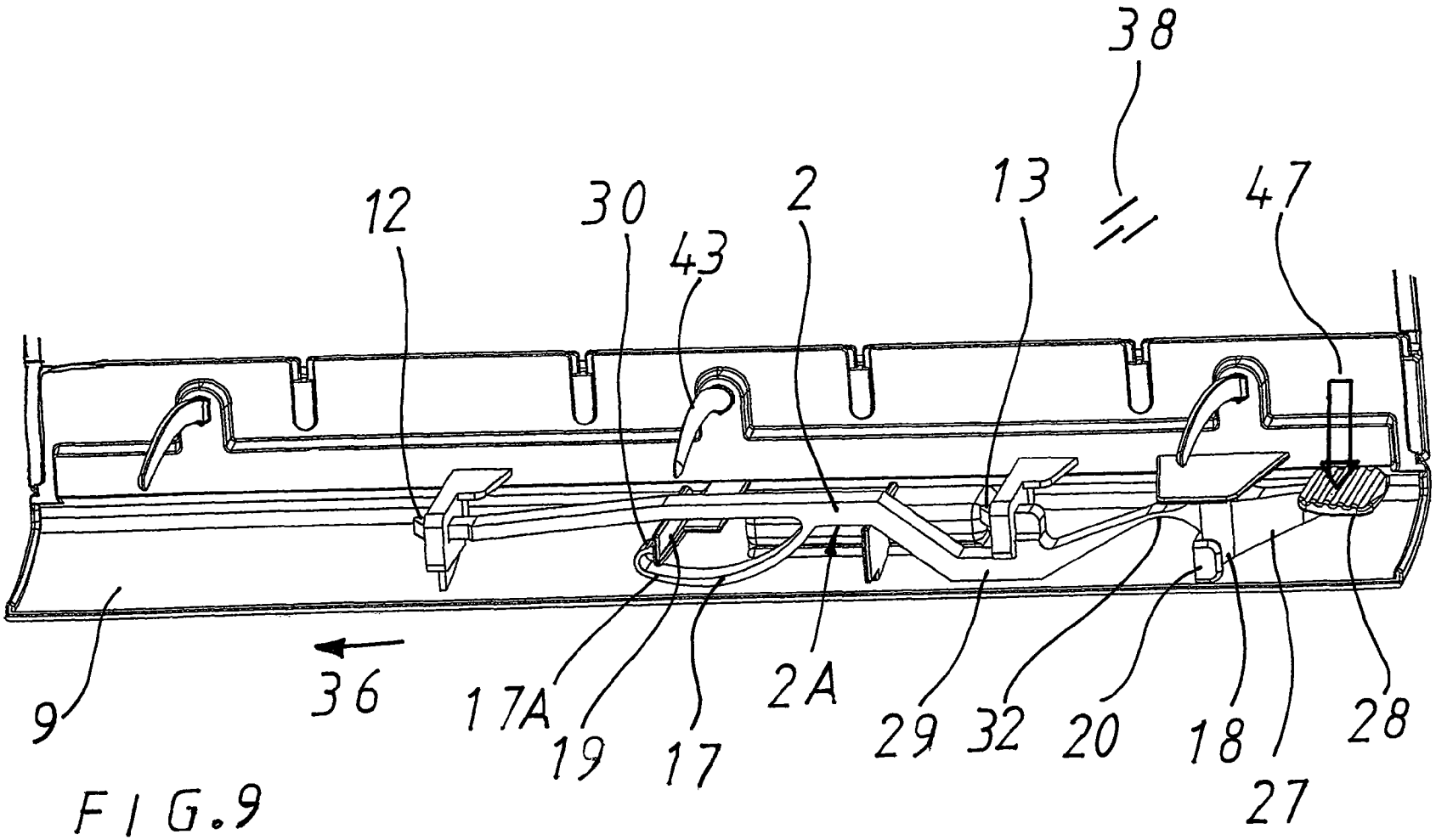

The invention is described in the following in the form of a preferred embodiment example, reference being made to the accompanying drawings in which, FIG. 1 shows in perspective a binder having a binder lock mechanism according to the invention applied thereto, FIG. 2 shows the mechanism in a partly opened position, FIG. 3 shows different sequences of the upper part of the mechanism in the various opening and locking positions, FIGS. 4-6 show the function of the upper part of the mechanism in a shutting and locking position of the binder and the mechanism, FIG. 7 shows the upper part of the mechanism in a shown locked position as sectioned, FIG. 8 shows parts of the binder and the mechanism in a disassembled state before assembling, and FIG. 9 shows the mechanism in the assembled state in one of the binder end halves.

A binder lock mechanism 1 comprises a manually adjustable locking bar 2 and a number of locking-hook parts 3, 4; 5, 6 co-operatable with said bar 2. According to the invention, there are locking-hook parts 3-6, projecting from a respective binder end half 8, 9, connected with the same, and arranged situated in pairs 3, 5; 4, 6 at mutual distances A, B from each other and mutually overlapable in pairs, said binder end halves being connected by an intermediate pivot joint 7. Said locking-hook parts 3, 5; 4, 6 present openings 10, 11 adapted to receive a respective lock lever 12, 13 connected with the locking bar 2. Said lock levers 12, 13 are permanently received in mating openings 11 of the appurtenant locking-hook parts 4, 6 in the assembled state of the locking bar 2 on the common binder end half 9. Said lock levers 12, 13 are arranged at the tip portion 14 and at a waved part 15, respectively, of the locking bar 2 in such a way that the two lock levers 12, 13 are situated substantially on a common line 16 through the bar 2. In that connection, the bar 2 is retained by means of a counter-directed resilient tongue 17, situated on the same, as well as a stopper 18 and co-operatable counter-stoppers 19, 20 situated on the binder end 9.

Said locking-hook parts 3, 4; 5, 6 have pair-wise mutually co-operatable stoppers 21, 22, which are arranged in such a way that they, in the active stop position I, see picture 1 in FIG. 3 and FIG. 7, respectively, place a lock lever 12 in one of the locking-hook parts 4 in a position right opposite a mating reception opening 10 of another locking-hook part 3, 5 included in the pair 3, 4; 5, 6. More precisely, the stopper of one of the locking-hook parts 3, 5 is formed by a thickening 21 and having a straight edge 23 that in the stop position I is abutable against an edge portion 22 having a straight edge 24 of the other locking-hook part 4, 6.

One of the pairs of locking-hook parts 3, 5 of one of the binder end halves 8 is arched and along which a curved row of at least two openings 10 is arranged.

Two pair-wise locking-hook parts 3, 4; 5, 6 are evenly distributed along the height extension of the binder and have planar pair-wise abutment surfaces 25, 26 co-operating with each other and against each other.

The locking-hook parts 3-6 and the locking bar 2 consist of a plastic material the locking-hook parts 3-6 having quadrangular shapes of the reception openings 10; 11 adapted to the cross-section shape of said lock levers 12, 13.

The locking bar 2 is resilient and has, on the underside 2A thereof, a lever portion applicable against a binder end 8, 9, more precisely that said stopper 18 forms a said lever portion together with the remaining lower part 27 of the bar 2 that extends toward a gripping member 28 intended for the thumb or another finger. The locking bar 2 has a deflected abutment portion 29 at the area of the lower-situated lock lever 13 thereof just in order to get the two lock levers 12, 13 aligned 16 with each other. The resilient tongue 17 is situated at the side 2A of the locking bar facing the binder end 9 and has, at the outer end 17A thereof, a formed gripping part 30 for abutment against a fixed stopper 19 of the binder 31. The locking bar 2 has a narrowed portion 32 in the area between the lower-situated opening actuation button 28 of the bar 2 and the deflected abutment portion 29 and that forms a joint of said bar 2. Said joint 32 allows the button 28 and the remaining part 33 of the bar 2 up to said joint 32 to be turned around a stopper 18 underneath at the same time as the other part 34 of the bar 2 is actuated by a downwardly pulling force F provided thereby to be displaced in the longitudinal direction of the bar 2 so as to provide maneuvering of said lock levers 12, 13 in a common direction downward 35.

When the button 28 is released, the bar 2 springs to move in the direction upward 36 toward the locking position I from said opened position II.

In order to allow easy insertion of the lock levers 12, 13 into mating intended desired openings 10, 11 in meeting locking-hook parts 3, 5 when the binder sides 37, 38 are shut together 39, 40, the end portions 12A, 13A of said axially movable lock levers 12, 13 have a pointed, angled shape with the angulation, i.e., the chamfering 45, 46, facing the appurtenant inter-connectable locking-hook part 3, 5.

The assembly of the few parts included in the mechanism is also easy to carry out and is easily understood with the aid of the figures. The counter-stopper 20 comprises an external plate 48 that efficiently retains the bar 2 and prevents the same from moving out from said binder end 9.

The function and the nature of the binder lock mechanism 1 described above should have been understood with the aid of the drawings. However, the function of the mechanism 1 of the appurtenant binder 31 will be explained briefly below.

The button 28 is pressed in the direction straight down 47 toward the end half 9 of the binder and turns around the stopper 18, which abuts against said end half 9. The remaining part 34 of the bar 2 is actuated, thanks to the bar 2 bending around the joint 32, to be pulled in the direction 35 in such a way that the lock levers 12, 13 are properly pulled into the appurtenant openings 11 in the appurtenant locking hooks 4, 6 in order to freely allowing the remaining appurtenant pair of locking hooks 3, 5 to be turned out to open the binder or in to shut the binder.

In that connection, the paper-holding prongs 42, 43 of the mechanism can be allowed to space apart from or approaching each other, thereby making it possible to open and shut, respectively, the binder 31.

When folding up the binder end halves 8, 9, it is also possible to press down the button 28 manually, but it can also be shut just by closing the binder sides 37, 38 and the binder end halves 8, 9 against each other. Thereby, the locking-hook parts 3, 5 actuate the tips of the lock levers to be pressed downward in such a way that, upon continued shutting of the binder, the lock levers 12, 13 spring up 36 to be received by the correct hole 10 in the co-operating and meeting locking-hook part 3, 5, for instance, such is shown in FIG. 7. If it is desired that another hole 10 receives the lock lever 12, 13, the button 28 is pressed in and the binder halves are brought into the desired position in such a way that the lock levers 12, 13 end up right opposite the correct hole 10.

Naturally, the invention is not limited to the embodiments described above and shown in the accompanying drawings. Modifications are feasible, particularly as for the nature of the different parts, or by using an equivalent technique, without departing from the protection area of the invention, such as it is defined in the claims.

The invention claimed is:

1. A binder lock mechanism, comprising a manually adjustable locking bar and pair-wise mutually overlappable locking-hook parts co-operative with the locking bar, wherein the pair-wise mutually overlappable locking-hook parts project from a respective binder end half, are connected with the same, and are situated at mutual distances from each other; the binder end halves are connected by an intermediate pivot joint; the pair-wise mutually overlappable locking-hook parts include openings adapted to receive respective lock levers connected with the locking bar; in an assembled state, the pair-wise mutually overlappable locking hook parts permanently receive in the openings respective lock levers on a common binder end half; the lock levers are arranged at a tip portion and at a waved part, respectively, of the locking bar in such a way that they are situated on a common line through the locking bar, which is retained by a counter-directed resilient tongue situated on the locking bar and a stopper and co-operatable counter-stoppers situated on a binder end;

wherein the pair-wise mutually overlappable locking-hook parts and the locking bar are a plastic material; the locking bar is resilient and has, on an underside thereof, a lever portion applicable against the binder end; the counter-directed resilient tongue is situated on the underside of the locking bar facing the binder end and has, at an outer end thereof, a gripping part for abutment against a counter-stopper of the binder; and the locking bar has a narrowed portion in an area between a lower-situated opening actuation button of the locking bar and a deflected abutment portion, and forms a joint of the locking bar that allows the actuation button to be turned around a stopper at the same time as the other part of the locking bar is actuated to be displaced in a longitudinal direction thereof so as to maneuver the lock levers.

2. The binder lock mechanism of claim 1, wherein the pair-wise mutually overlappable locking-hook parts have pair-wise mutually co-operatable stoppers arranged such that, in an active stop position, the co-operatable stoppers place a lock lever in one of a pair of the pair-wise mutually overlappable locking-hook parts in a position opposite an opening included in the other one of the pair of pair-wise mutually overlappable locking-hook parts.

3. The binder lock mechanism of claim 2, wherein the stopper of one of the pair of pair-wise mutually overlappable locking-hook parts is a thickening that is abutable against an edge portion of the other one of the pair of pair-wise mutually overlappable locking-hook parts.

4. The binder lock mechanism of claim 1, wherein the pair-wise mutually overlappable locking-hook parts of one of the binder end halves are arched.

5. The binder lock mechanism of claim 1, wherein the lock levers are evenly distributed along a height dimension of the binder and have planar pair-wise surfaces cooperating with and against each other.

6. The binder lock mechanism of claim 1, wherein the pair-wise mutually overlappable locking-hook parts have quadrangular reception openings adapted to a cross-sectional shape of the lock levers.

7. The binder lock mechanism of claim 1, wherein the locking bar has a deflected portion in an area of a lower-situated lock lever thereof.

8. The binder lock mechanism of claim 1, wherein the end portions of the lock levers have a pointed angled shape with the angulation facing the appurtenant pair-wise mutually overlappable locking-hook part.

* * * * *